US005634823A

United States Patent [19]

Furuta et al.

[11] Patent Number: 5,634,823

[45] Date of Patent: Jun. 3, 1997

[54] ELECTRICAL ELEMENT SOCKET

[75] Inventors: Yoshiaki Furuta; Junji Muta, both of Yokkaichi, Japan

[73] Assignee: Sumitomo Wiring Systems, Ltd., Japan

[21] Appl. No.: 391,969

[22] Filed: Feb. 21, 1995

[30] Foreign Application Priority Data

Feb. 18, 1994 [JP] Japan ..... 6-044953
Sep. 1, 1994 [JP] Japan ..... 6-234374

[51] Int. Cl.[6] ..... H01R 17/00

[52] U.S. Cl. ..... 439/699.2; 439/619

[58] Field of Search ..... 439/699.1, 699.2, 439/611–619, 356, 593, 375

[56] References Cited

U.S. PATENT DOCUMENTS 3,710,303 1/1973 Gallager, Jr. ..... 439/593
4,473,770 9/1984 Baba et al. ..... 439/699.2
4,624,524 11/1986 Durand ..... 439/699.2
4,883,434 11/1989 Toyoshima ..... 439/699.2
5,008,588 4/1991 Nakahara ..... 439/619

FOREIGN PATENT DOCUMENTS 0038431 10/1981 European Pat. Off. .
2002059 3/1969 France .
1247850 9/1971 United Kingdom .

*Primary Examiner*—Hien Vu
*Attorney, Agent, or Firm*—Jordan B. Bierman; Bierman, Muserlian and Lucas LLP

[57] ABSTRACT

An arm formed in the wall of an element receptacle undergoes elastic deformation under the influence of a contact fitting. Accordingly, wider range tolerances in the elements can be accommodated without causing permanent deformation of the contact fitting. As an alternative construction, there is a locking part on the receptacle which does not deform, but instead the contact fitting is displaced as the element is inserted.

6 Claims, 9 Drawing Sheets

ELECTRICAL ELEMENT SOCKET

This Application claims the priorities of Japanese Applications 6-44953 and 6-234374, filed Feb. 18, 1994 and Sep. 1, 1994, respectively.

The present Invention relates to an electrical element socket, more specifically to a socket for tightly retaining the base of a bulb.

BACKGROUND OF THE INVENTION

A bulb socket known to the prior art is shown in FIG. 16. Bulb 1 includes flat base 2 and lead wires 3, provided at each of the opposite side surfaces of base 2. Bulb socket 4 includes cylindrical bulb receptacle 5 having an opening to accommodate base 2 therein. A pair of fittings 6 are disposed along the inner surface of bulb receptacle 5.

Guide plates 6*a* are inserted along groove 5*a* formed in receptacle 5 to properly position fitting 6. A rear part of guide plate 6*a* with respect to its insertion direction is cut and bent outward, thereby forming engaging portion 6*a*1. An angular portion at the leading end of engaging portion 6*a*1 digs into the inner wall of receptacle 5, thereby preventing fitting 6 from easily coming out of receptacle 5. Each fitting 6 is also formed with retaining portion 6*b* having an arm-like configuration which extends in its insertion direction. Retaining portion 6*b* has at its leading end contact portion 6*b*1 which is triangularly curved to project inward of receptacle 5 and is engageable with corresponding projection 2*a* formed on the base 2.

In this bulb socket, when base 2 of bulb 1 is inserted into bulb receptacle 5, projections 2*a* come into contact with retaining portion 6*b* of fittings 6, thereby bending retaining portion 6*b* outward. When base 2 is inserted deeper into bulb receptacle 5, retaining portion 6*b* moves over corresponding projections 2*a* to lock bulb 1 in place. In this position, base 2 is tightly retained by fittings 6 between portion 6*b* and projections 2*a*, thereby to prevent base 2 from slipping out of bulb receptacle 5.

When wedge-base bulb 1 is withdrawn, projections 2*a* press contact portions 6*b*1 as they move upward, thereby forcing contact portions 6*b*1 outward. As a result, contact portions 6*b*1 move over projections 2*a*. Although contact portions 6*b*1 are pulled upward by the projections 2*a* at this stage, the angular portions at the leading ends of engaging portions 6*a*1 of guide plates 6*a* dig into the inner walls of receptacle 5 to restrict the upward movement of contact portions 6*b*1.

However, if the projections 2*a* of the base 2 are large, it becomes difficult for them to move over contact portions 6*b*1. Thus, the force used to pull bulb 1 upward acts to pull the contact portions 6*b*1 upward. Since the size tolerance of the bulb 1 is large, there are cases where fittings 6 cannot be retained in receptacle 5 only by engaging portions 6*a*1. As a result, fittings 6 are pulled out of receptacle 5 when bulb 1 is withdrawn.

The foregoing conventional bulb socket retains a part of the electric bulb by bending the fittings. However, electric bulbs are subject to variations in dimensions. Even if the bulb socket is fabricated to conform to the standard size, the bulb may vary within manufacturing tolerances. When the bulb, especially its socket or the projections thereon, is oversized, the fittings may be bent beyond the elastic limit and be permanently distorted. When the electric bulb is undersized, the forces exerted thereon by the fitting may be too weak so that the bulb may fall out of or be shaken loose from the socket. This tendency is of particular concern in relation to wedge-base bulbs or the like which are made entirely of glass because the manufacturing tolerances thereof are larger.

SUMMARY OF THE INVENTION

In view of the above problems, it is an object of the Invention to provide a socket capable of suitably retaining an electrical element even though it may vary greatly from the normal intended dimensions. For clarity, the Invention will be described in connection with an electric light bulb, but it is not to be so limited.

The first aspect of the Invention is directed to a bulb socket comprising a bulb receptacle and a contact fitting on the inner wall surface thereof, with the bulb socket electrically contacting the base of an electric bulb inserted therein. The bulb receptacle is formed with a support member adapted for elastic deformation to support and bear against the contact fitting. The support member may comprise an arm formed by cutting two parallel slits extending from the opening edge of the wall of the receptacle toward the bottom thereof; the upper end of the arm is bent to elastically support the contact fitting. When the contact fitting is pressed against a part of the arm, the arm is bent while being connected to the wall of the bulb receptacle, which thereby shares the load with the contact fitting.

In a modification of the foregoing, the arm is provided at its open end with a tubular end which is open in the direction of the opening of the bulb receptacle, and an end of the contact fitting is bent outward of the bulb receptacle into a U-shape. The leading end of the bent end of the contact fitting is insertable into the tubular end, thereby constituting a locking device. Since the support member undergoes elastic deformation to support the contact fitting which tightly holds the base of the electric bulb, the support member supports the contact fitting while being bent together therewith if the base is slightly oversized.

Additionally, the end of the contact fitting may be turned up into U-shape and inserted into the opening of the tubular end formed at the arm from the open side of the bulb receptacle. After the insertion of the electric bulb into the bulb receptacle, the contact fitting is pushed outward and the leading end thereof is bent outward and engages the tubular end. When the electric bulb is withdrawn, the force also tends to withdraw the contact fitting. However, since the leading end of the contact fitting engages the tubular end, the contact fitting is prevented from moving out of the bulb receptacle. Thus, the contact fitting is not subject to permanent deformation even if the base of the electric bulb is slightly oversized. By making the dimensions of the bulb socket such that it can hold smaller bases, the bulb socket is capable of retaining bulbs having a wide range of sizes.

According to a second aspect of the Invention, the bulb socket preferably comprises a housing including a bulb receptacle, into which the base of a wedge-base bulb is inserted, and a fitting, which is inserted along an opening direction of the housing. The fitting electrically connects the bulb socket while securely retaining the base thereof which is inserted into the receptacle. The fitting is formed with an engaging end bent to extend outwardly of the receptacle, and the upper surface of the engaging end comes into contact with the engaging wall surface formed on the receptacle from below. Accordingly, even if the wedge-base bulb is pulled upward, the engaging end prevents the fitting from coming out of the receptacle. In a preferred embodiment, the receptacle is formed with an engaging wall which is positioned outwardly of the inner wall surface thereof, and the engaging wall surface is formed at a lower part of the engaging wall.

When the base of the wedge-base bulb is oversized, a larger force is required to pull the bulb upward. However, even when a large force acts to bring the engaging end into contact with the engaging wall surface, the leading end of the fitting is allowed undergo sufficient elastic deformation or deflection to prevent damage thereto.

Preferably the receptacle comprises inner and outer walls at its opening edge and the engaging wall is formed by the outer wall. The leading end of the fitting is bent in a U-shape and is inserted into the clearance between the inner and outer walls. It is bent outward at the lower end face of the engaging wall to form the engaging end.

When the bulb is inserted into the receptacle, the fitting is forced outward and the bent end thereof comes into contact with the inner surface of the engaging wall, i.e. the outer wall. The engaging end faces the engaging wall surface formed at the lower end face of the engaging wall. If a force urges the fitting upward when the bulb is withdrawn, the engaging end comes into contact with the lower end face of the engaging wall, and prevents the fitting from coming out of the receptacle. When the bulb is not inserted, the bent portion is retained between the inner and outer walls.

In a further preferred embodiment, a through hole is formed in the wall of the receptacle adjacent the opening edge thereof and the engaging wall surface is formed by the upper wall surface defining the through hole. The engaging end is engageable with the through hole defined in the wall of the receptacle adjacent the opening edge thereof. Accordingly, when a force tends to pull the fitting upward, the engaging end comes into contact with the upper wall surface thereby preventing the fitting from coming out of the receptacle. Preferably the leading end of the fitting is bent substantially at a right angle to the inserting/withdrawing direction of the bulb so that it engages the wall surface of the receptacle. Thus, the construction can be simplified.

BRIEF DESCRIPTION OF THE DRAWINGS

These and other objects, features and advantages of the present Invention will become more apparent upon a reading of the following detailed description and accompanying drawings wherein:

Referring to FIG. 1, wedge-base bulb 10 includes flat base 11 integrally formed at its bottom. Projected portion 12 is formed on each of opposite side surfaces of base 11. Projected portion 12 includes first projection 12*a*, formed in the middle of side surface 7 with respect to the lateral direction; second projection 12*b*; and third projection 12*c*, formed at the opposite lateral ends of side surface 7. The leading end of lead wire 13 projecting from the bottom surface of the base 11 is turned upwardly so that it is located between first and second projections 12*a* and 12*b*.

Figure 1:
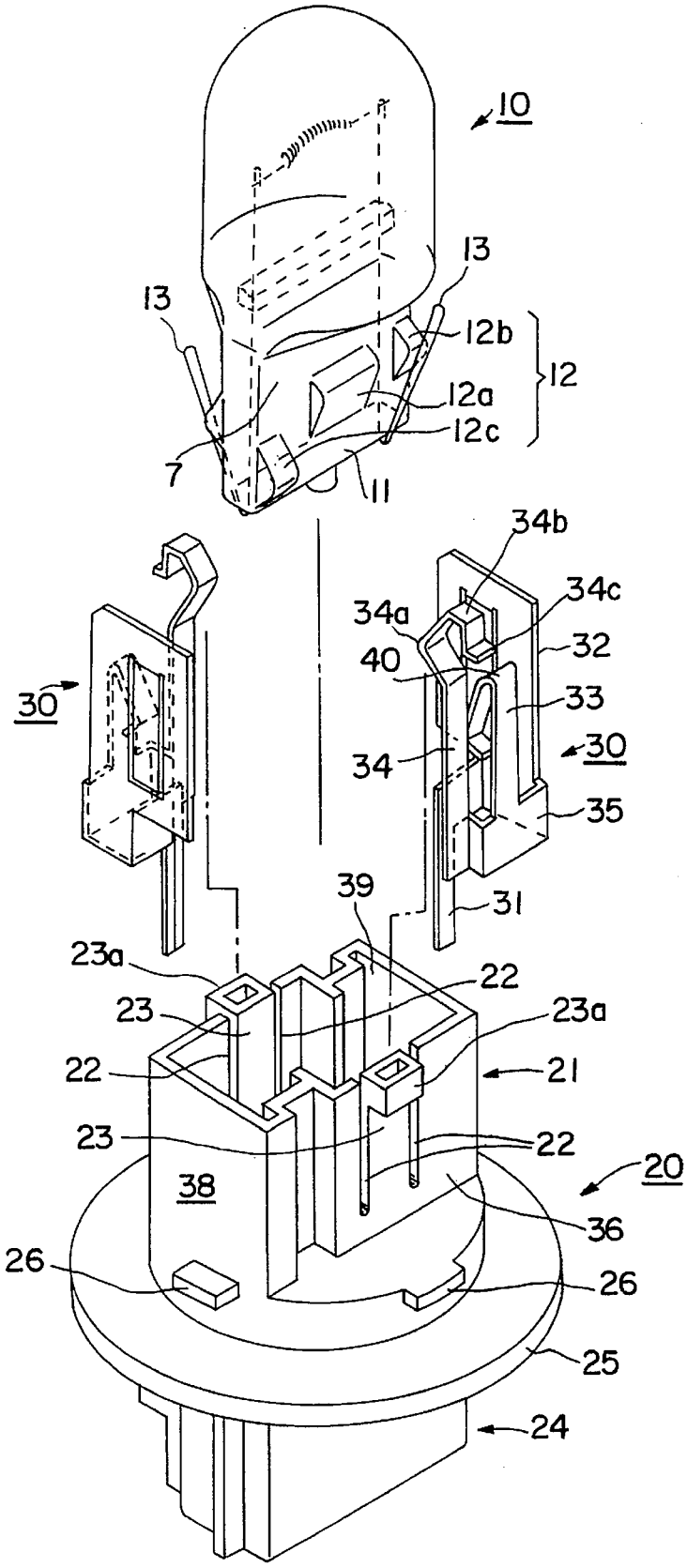
FIG. 1 is an exploded perspective view of the bulb socket according to one embodiment of the Invention.

Bulb socket 20 includes bulb receptacle 21 having an opening of substantially rectangular cross section into which base 11 of bulb 10 can be inserted. In the middle of each longitudinal side wall 36 of receptacle 21, there are formed two slits 22 which extend down from the open edge. Arm 23, bendable inwardly and outwardly with respect to the longitudinal side wall 36, is formed between slits 22. The leading end of arm 23 is provided with tubular member 23*a* which projects outward from longitudinal side wall 36. At the underside of the bottom wall of bulb receptacle 21, there is formed connector plug 24 which may be inserted into a female connector (not shown). Flange 25 is provided between receptacle 21 and plug 24, and engaging projections 26, which are adapted to engage a specified mounting hole in cooperation with flange 25, are on outer surface 38 of receptacle 21.

Contact fitting 30, preferably made by bending a single heat resistive copper alloy plate, includes terminal 31, support plate 32, electrode 33, movable contact 34, and connecting portion 35 which electrically connects the other members of contact fitting 30. Terminal portion 31 is a plate member, preferably formed by folding a part of the alloy plate to double thickness; the member projects downward through the bottom wall of bulb receptacle 21 into the opening of connector plug 24, thus acting as a male terminal. Support plate 32 is held in contact with the corresponding narrower surface, i.e., end surface 39 in receptacle 21. By being in surface-to-surface contact with end surface 39, support plate 32 is positioned stably and accurately. A center portion of support plate 32 is press-worked to project, preferably toward end surface 39 of the receptacle 31, thereby forming a reinforcing bead. Electrode 33 projects upward from connecting portion 35 to face lead wire 13 of bulb 10. Upper end 40 of electrode 33 is formed by bending the leading end of a belt-like plate piece inward of receptacle 21 to form a slanting surface which projects further inward as it extends downward.

Movable contact 34 projects upward from connecting portion 35 and includes pressing portion 34*a* formed by bending the leading end inward of receptacle 21. Bearing portion 34*b* is formed by bending the leading end of contact member 34 toward connecting portion 35 into a substantially U-shape, open in a direction outward of bulb receptacle 21. The leading end of bearing portion 34*b* is bent outward to form locking end 34*c*. The size of bearing portion 34*b*, including locking end 34*c*, is such that it can be inserted into tubular end 23*a* of arm 23 through its upper opening.

Figure 2:
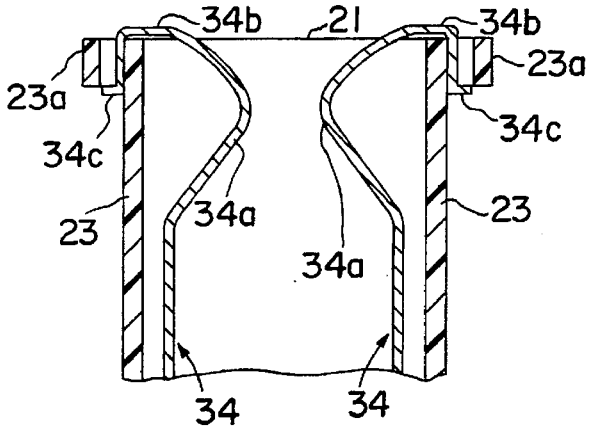
FIGS. 2 to 4 are partial sections showing the insertion of the bulb socket.

As shown in FIG. 2, the socket is assembled by inserting contact fittings 30 into receptacle 21, thereby causing support plate 32 to slide along inner end surfaces 39. Just before terminal fitting 30 reaches its predetermined bottom position, bearing portion 34*b* of movable contact 34 enters tubular end 23*a* of arm 23. At the predetermined bottom position, locking end 34*c* out of tubular end 23*a*. When bulb 10 has not yet been inserted, bearing portion 34*b* of movable contact 34 is retained by contact of its inner surface with the outer surface of arm 23 and the engagement of tubular end 23*a* by locking end 34*c*.

Figure 3:
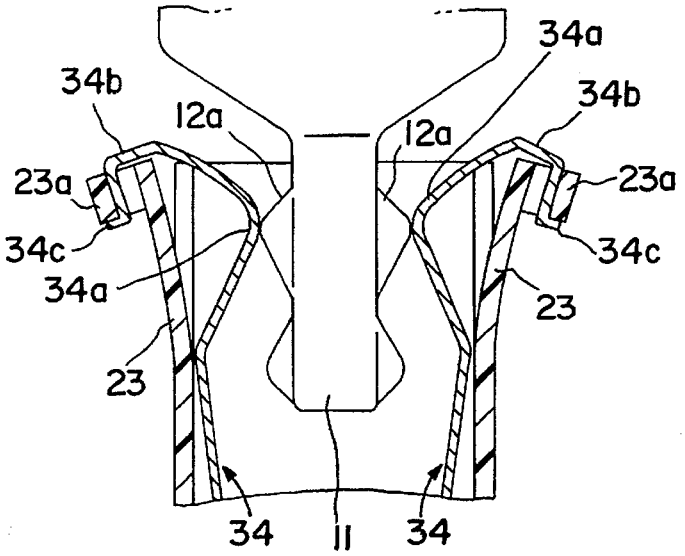

As base 11 of bulb 10 is inserted into receptacle 21, it enters between opposed movable contacts 34, thereby pressing and bending members 34 outward (See FIG. 3). To accommodate the thickness of base 11 of bulb 10 therebetween, movable contacts 34 are bent so that the outer surfaces of bearing portions 34*b* bear against the inner surfaces of the outer walls of tubular ends 23*a* of the arms 23. On contacting pressing portions 34*a*, first projections 12*a* urge contacts 34 further outwardly. At this stage, bearing portions 34*b* press tubular ends 23*a* outward, thereby bending arms 23.

Figure 4:
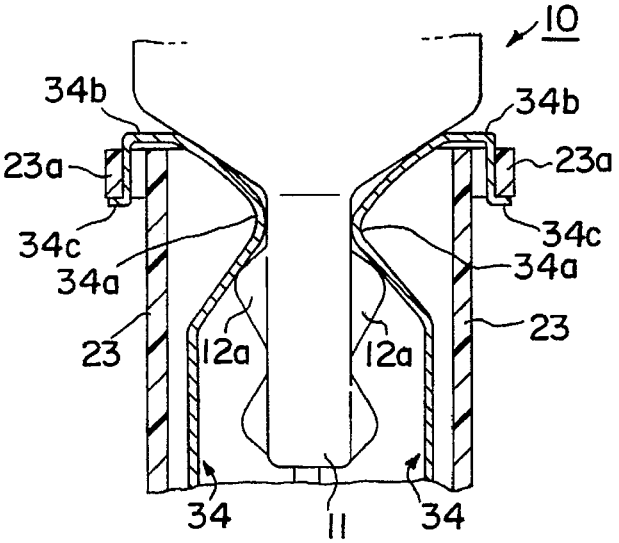
Figure 5:
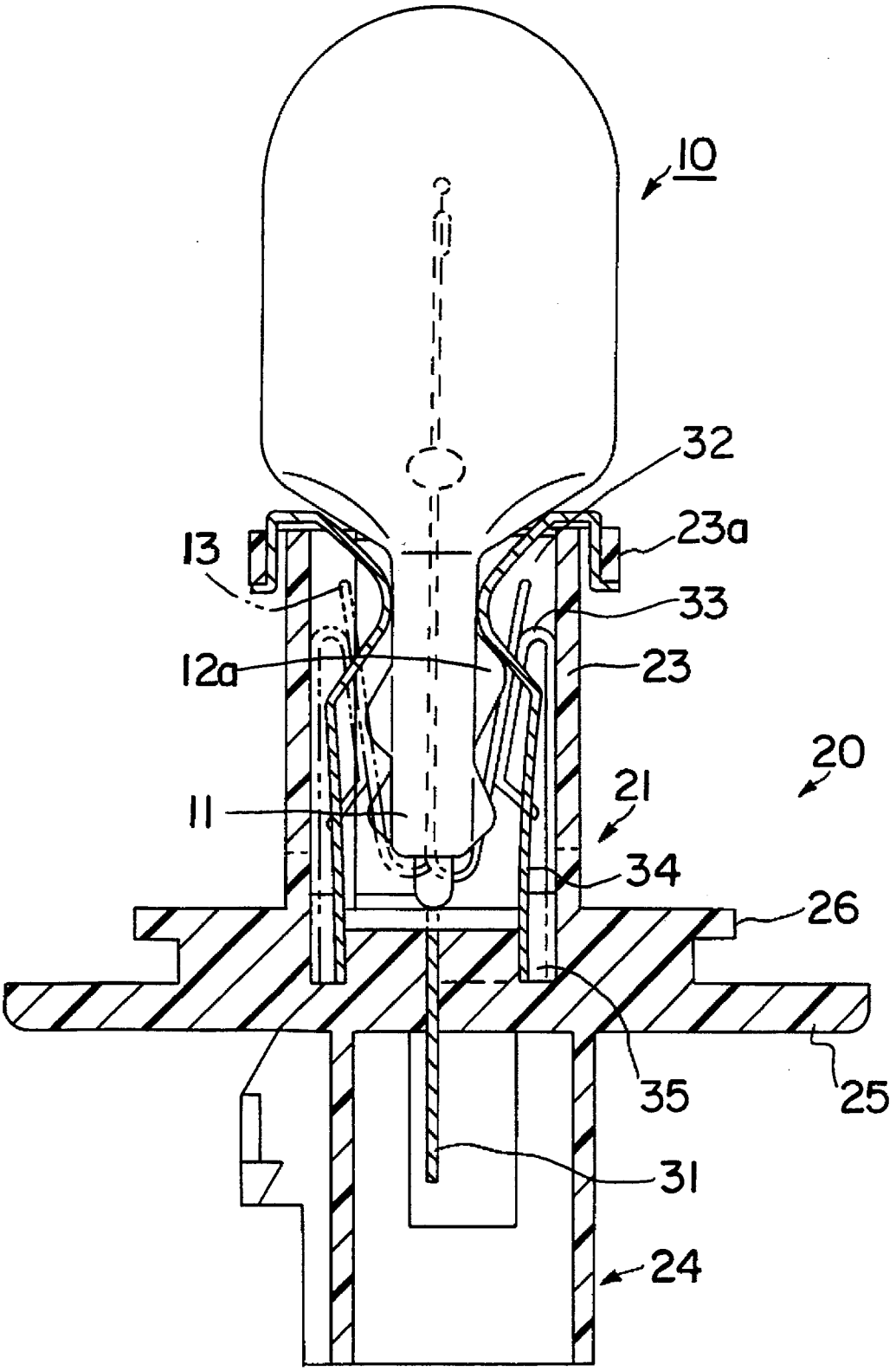
FIG. 5 is a section of the inventive bulb socket.

After the first projections 12*a* move over pressing portions 34*a*, arms 23 return substantially to their original shape as shown in FIG. 4. The innermost portion of pressing portion 34*a* is now in contact with a portion of base 11 above first projection 12*a* on bulb 10. In this position, due to the thickness of base 11 at that point, bearing portion 34*b* is preferably in contact with the inner wall of the outer part of tubular end 23*a*. As shown in FIG. 5, electrodes 33 are in contact with lead wires 13 turned up along the side surfaces of base 11, thereby establishing an electrical connection between lead wires 13 and terminals 31.

Even if bulb 10 is slightly undersized, socket 20 is capable of retaining bulb 10 so long as the thickness of base 11 is sufficient to urge pressing portions 34*a* slightly outwardly. On the other hand, if bulb 10 is oversized, arms 23 are bent outward and, together with contact fittings 30, retain base 11. Thus, the socket 20 is capable of dealing with the wide manufacturing tolerances of bulb 10. When bulb 10 is withdrawn, first projections 12*a* contact pressing portions 34*a* and tend to withdraw contact fittings 30. However, this is prevented by locking ends 34*c* which engage the lower side of tubular ends 23*a*.

Since movable contacts 34 of fittings 30 are supported by the elastic force of arms 23 formed in side walls 36 of receptacle 21, the range of electric bulbs which can be retained by socket 20 without causing permanent deformation is greatly enlarged.

Figure 6:
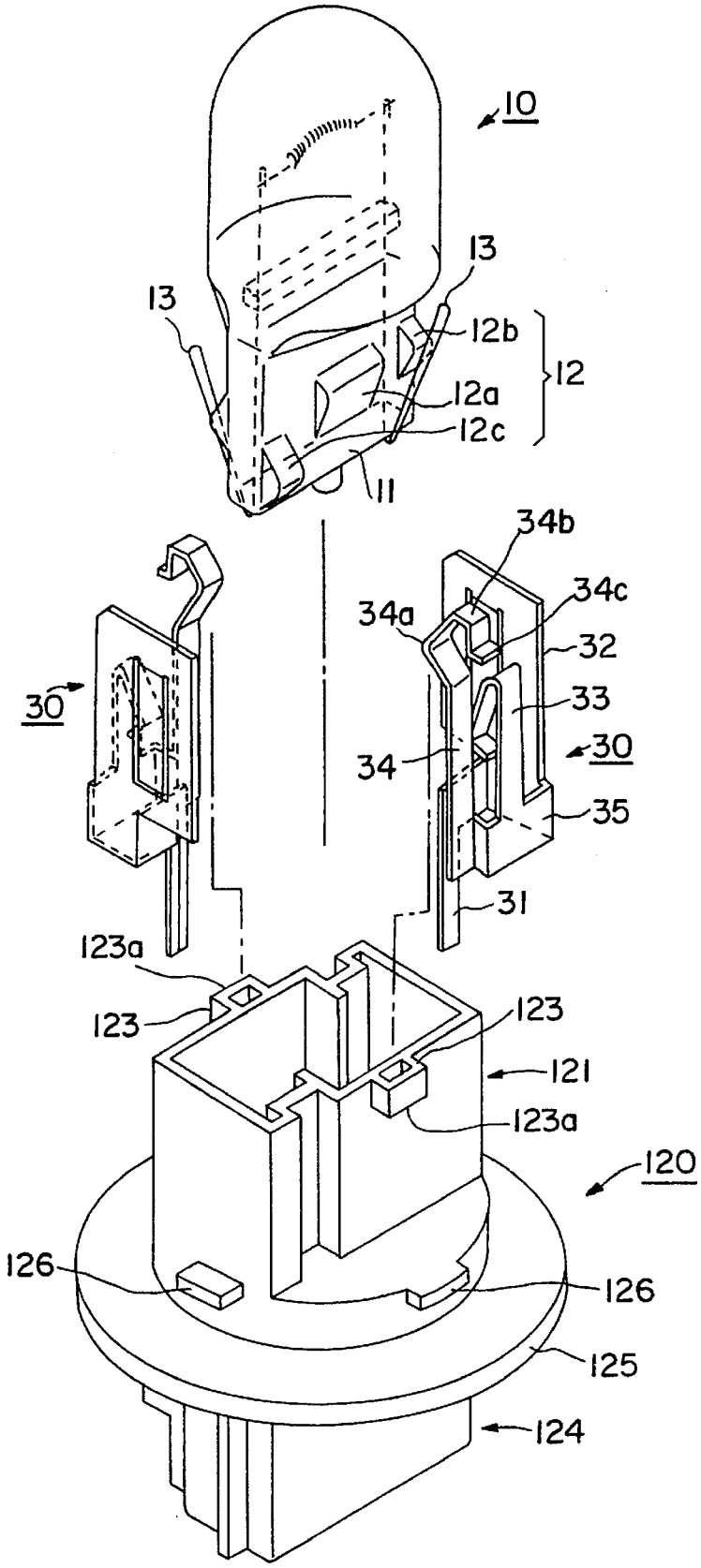
FIG. 6 is an exploded perspective view of a bulb socket according to the second embodiment of the invention.

In FIG. 6, bulb 10 includes flat base 11 integrally formed at its bottom. Projected portion 12 is formed on each of the opposite side surfaces of base 11. Projected portion 12 includes first projection 12*a* in the middle of the side surface in the lateral direction, and second projection 12*b* and third projection 12*c* at the opposite lateral ends of the side surface. The leading end of lead wire 13 projects from the bottom surface of base 11 and is turned upward so that it is located between first and second projections 12*a* and 12*b*.

Bulb socket 120 includes receptacle 121 having an opening of substantially rectangular cross-section into which base 11 of bulb 10 is insertable. In the middle of each longitudinal side wall of receptacle 121, an element of U-shaped cross-section is connected to the flat wall surface, thereby forming auxiliary wall 123 which is a tubular portion in the same direction as receptacle 121. The tubular portion formed by auxiliary wall 123 has a rectangular cross-section. A wall of this tubular portion facing the wall of receptacle 121 forms engaging wall 123*a* to be described later. A lower end face of engaging wall 123*a* forms engaging wall surface 123*a*1. Here, two walls are formed by the outer wall of receptacle 121 and engaging wall 123*a*. At the underside of the bottom wall of receptacle 121, there is formed connector receptacle 124 into which a female connector can be inserted. Flange 125 is provided between receptacles 124 and 121, and engaging projections 126, which engage a specified mount hole in cooperation with flange 125, are on the outer surface of receptacle 121.

Contact fitting 30 is made by bending a single heat resistive copper alloy plate and includes terminal portion 31, support plate 32, electrode 33, movable contact member 34, and connecting portion 35 to electrically connect the other elements of contact fitting 30. Terminal portion 31, which is formed into a plate member by folding a part of the alloy plate to double the thickness, projects downward through the bottom wall of receptacle 121 of bulb socket 120 into the opening of connector receptacle 124, thus acting as a male terminal. Support plate 32 is held in contact with the corresponding end surface in receptacle 121. By being in surface-to-surface contact with the end surface, support plate 32 can be positioned more stably and accurately. A center portion of support plate 32 is press-worked to project, thereby forming a reinforcing bead. Electrode 33 projects upward from connecting portion 35 at a position facing lead wire 13 of bulb 10. Electrode 33 is formed by bending the leading end of a belt-like plate piece inward of receptacle 121 to form a slanting surface which projects further inward as it extends downward.

Movable contact member 34 projects upward from connecting portion 35 substantially in the middle of receptacle 121 and includes peaked pressing portion 34*a* formed by bending its leading end inward of receptacle 121. There is turned-up portion 34*b* formed by turning up the leading end of the contact member 34 toward connecting portion 35 into a U-shape in a direction outward of receptacle 121. The leading end of the turned-up portion 34*b* is bent outward to form engaging end 34*c*. Engaging end 34*c* is turned up substantially by a distance such that it can be inserted from above into the clearance defined by the outer wall surface of receptacle 121 and auxiliary wall 123 while sliding the turned-up portion 34*b* along the outer wall surface of receptacle 121. Portion 34*b* has a length such that engaging end 34*c* stays in a position beyond and below engaging wall surface 123*a*1 of the auxiliary wall.

Figure 7:
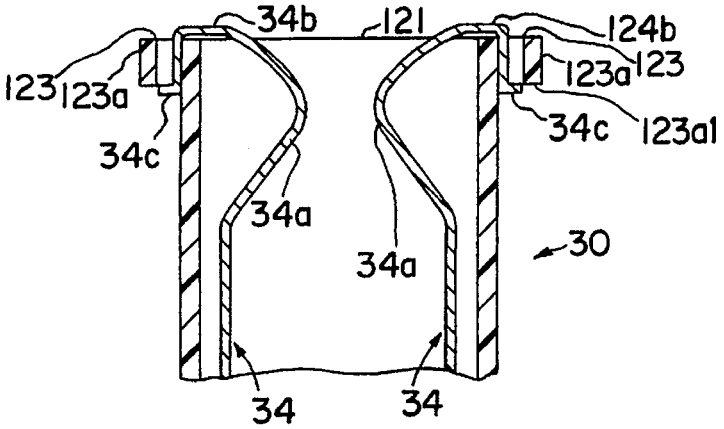
FIGS. 7 to 9 are partial sections showing the insertion of the bulb socket.

With reference to FIGS. 7 to 10, contact fittings 30 are mounted in receptacle 121 of bulb socket 120. Contact fitting 30 is inserted deeper into receptacle 121, causing support plate 32 to slide along the inner end surfaces of receptacle 121. Just before terminal fitting 30 reaches a predetermined bottom position, the leading end of turned-up portion 34*b* of movable contact member 34 is inserted into the clearance defined by receptacle 121 and auxiliary wall 123. At the predetermined bottom position, engaging end 34*c* is beyond or below engaging wall surface 123*a*1. As shown in FIG. 7, when bulb 10 is not inserted, turned-up portion 34*b* of movable contact member 34 is retained by contact of its inner surface with the outer surface of auxiliary wall 123 and end 34*c* is not engaged.

Base 11 of bulb 10 is inserted into receptacle 121 between opposed movable contact members 34, thereby pressing and bending members 34 outward. To accommodate the thickness of base 11 therebetween, movable contact members 34 are designed so that the outer surfaces of turned-up portions 34*b* come into contact with the inner surfaces of engaging walls 123*a*.

Figure 8:
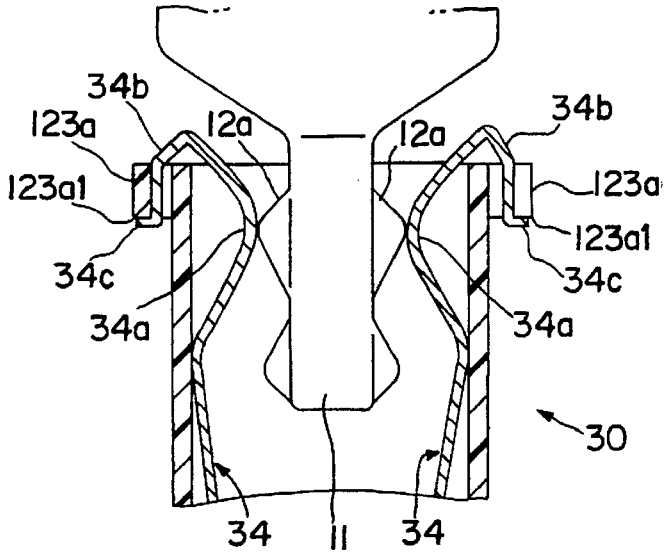

Upon coming into contact with pressing portions 34*a* of contact member 34, first projections 12*a* press contact members 34 further outward. At this stage, as shown in FIG. 8, portions of contact members 34 adjacent pressing portions 34*a* elastically deflect. When moving over corresponding pressing portions 34*a*, first projections 12*a* come into contact with the slanting surfaces formed on the upper parts of pressing portions 34*a*, thereby urging pressing portions 34*a* simultaneously outward and downward.

However, since contact fittings 30 have been inserted to bottom of receptacle 121, their positions will not be changed by this downward acting force.

In this embodiment, engaging walls 123*a* are outward of the wall of receptacle 121. Accordingly, the outward displacement of movable contact members 34 becomes greater, when first projections 12*a* move over pressing portions 34*a*, thus widening the spacing therebetween. This allows contact members 34 to elastically deflect through a wider range.

Figure 9:
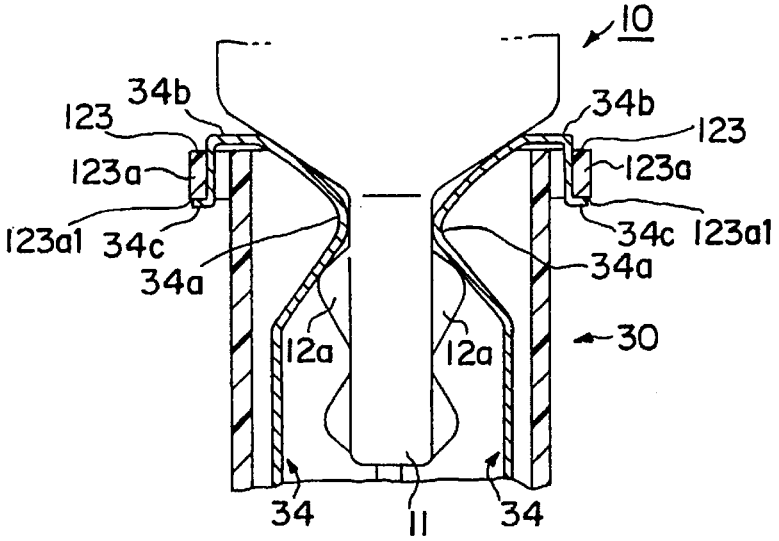
Figure 10:
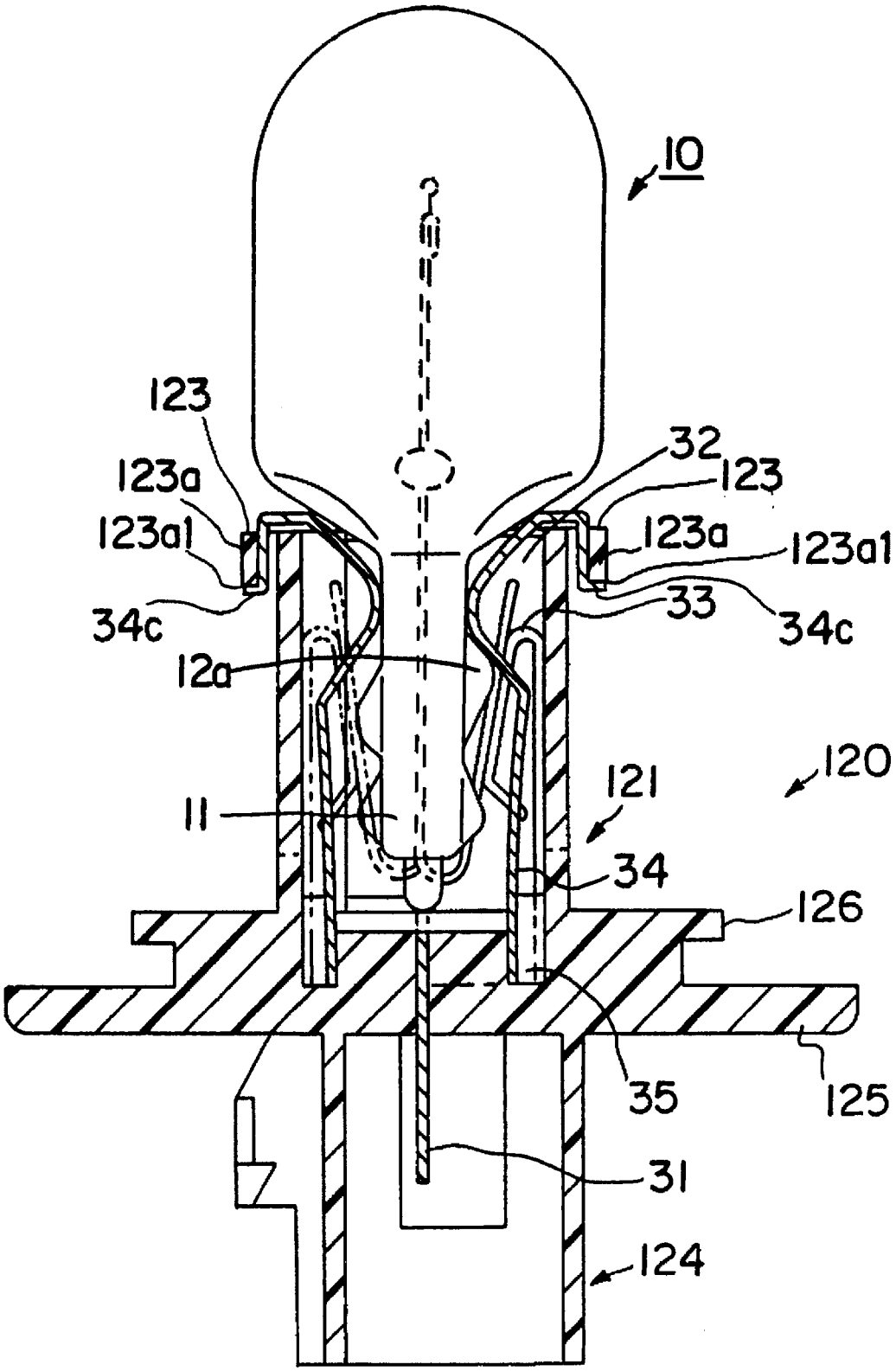
FIG. 10 is a section of the bulb socket.

After first projections 12*a* move over corresponding pressing portions 34*a*, contact members 34 return substantially into their original shape as shown in FIG. 9, since contact members 34 only hold the base 11 tightly between pressing portions 34*a*. In this position, as shown in FIG. 10, electrodes 33 are in contact with lead wires 13 turned up along the side surfaces of base 11, thereby establishing electrical connection between corresponding lead wires 13 and terminal portions 31.

Let it be assumed that the bulb 10 needs to be withdrawn because it has burned out. When bulb 10 is withdrawn upwardly (as shown in FIG. 9), first projections 12*a* come into contact with slanting surfaces formed on the lower parts of pressing portions 34*a*, which are thereby pressed outwardly and pulled upwardly (as shown in FIG. 8). However, since engaging ends 34*c* are on the outside of receptacle 121 and the upper surfaces thereof are in contact with engaging wall surfaces 123*a*1 as shown in FIG. 9, contact members 34 cannot move upward. Accordingly, first projections 12*a* move over pressing portions 34*a* while pressing them outward to widen the spacing therebetween. After bulb 10 is withdrawn, engaging ends 34*c* are no longer in contact with engaging wall surfaces 123*a*1 as shown in FIG. 7.

As described above, engaging ends 34*c* are bent outward substantially at right angles to the open direction of receptacle 121 at the leading ends of contact members 34. Engaging ends 34*c* come, from below, into contact with engaging wall surfaces 123*a*1 at the lower end faces of engaging walls 123*a* on the outside of receptacle 121. Accordingly, even if a force acts to urge contact members 34 upward when bulb 10 is withdrawn, engaging ends 34*c* come into contact with engaging wall surfaces 123*a*1 to resist this force. Thus, contact fittings 30 are prevented from coming out of receptacle 121.

Figure 11:
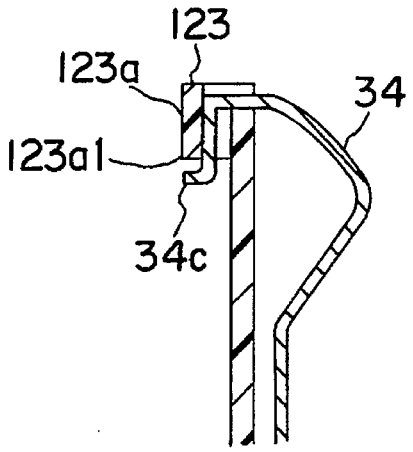
FIG. 11 is a partial section of another embodiment of the bulb socket.
Figure 12:
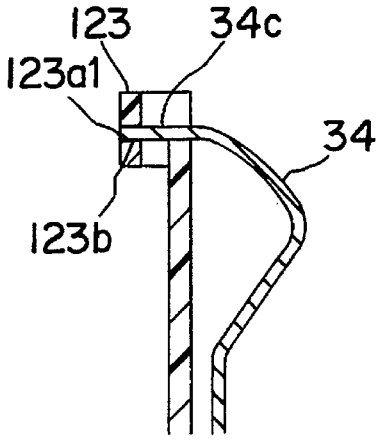
FIG. 12 is a partial section of a further embodiment of the bulb socket.
Figure 13:
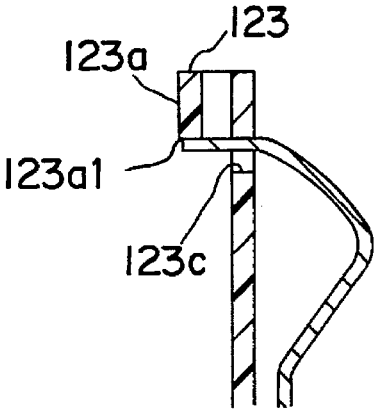
FIG. 13 is a partial section of a still further embodiment of the bulb socket.

FIGS. 11 to 13 show further modifications of the Invention. Although the upper end face of the wall of receptacle 121 and that of auxiliary wall 123 are flush with each other in the foregoing embodiment, the upper end face of auxiliary wall 123 may be beyond that of the wall of the receptacle as shown in FIG. 11. In this arrangement, contact member 34 is less exposed. Thus, movable contact member 34 is less subject to permanent deformation which occurs, e.g. when bulb 10 is forcibly inserted.

In the modification shown in FIG. 12, engaging end 34*c* is formed by bending the leading end of contact member 34 to linearly extend outwardly of receptacle 121. Further, auxiliary wall 123 has through hole 123*b* where wall 123 faces engaging end 34*c*. As bulb 10 is inserted into receptacle 121, contact members 34 elastically deflect outwardly and the leading ends of engaging ends 34 are pressed into through holes 123*b*. When bulb 10 is withdrawn, engaging ends 34*c* come into contact with engaging wall surfaces 123*a*1 at the upper wall surfaces which define through holes 123*b*, thereby preventing contact fittings 30 from coming out of receptacle 121.

As shown in FIG. 13, similar to the modifications shown in FIG. 12, engaging end 34*c* is formed by bending the leading end of movable contact member 34 to linearly extend outwardly of receptacle 121, there is through hole 123*c* in receptacle 121, and auxiliary wall 123 is provided. When contact fittings 30 are inserted into receptacle 121, engaging end 34*c* is pressed outward and enters through hole 123*c*. As a result, engaging end 34*c* projects underneath the lower end face of auxiliary wall 123. Hence, contact member 34 is even less exposed. In the embodiments shown in FIGS. 11 to 13, contact member 34 is less exposed because it is located below the open edge of receptacle 121. Thus, contact member 34 is less likely to contact an external metal member, thereby preventing short-circuiting.

Figure 14:
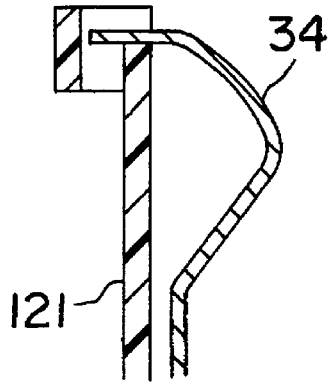
FIG. 14 is a partial section of yet another embodiment of the bulb socket.
Figure 15:
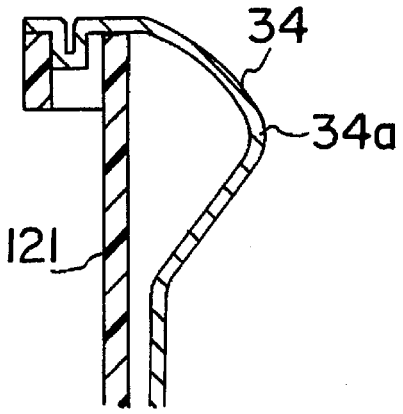
FIG. 15 is a partial section of still another bulb socket.
Figure 16:
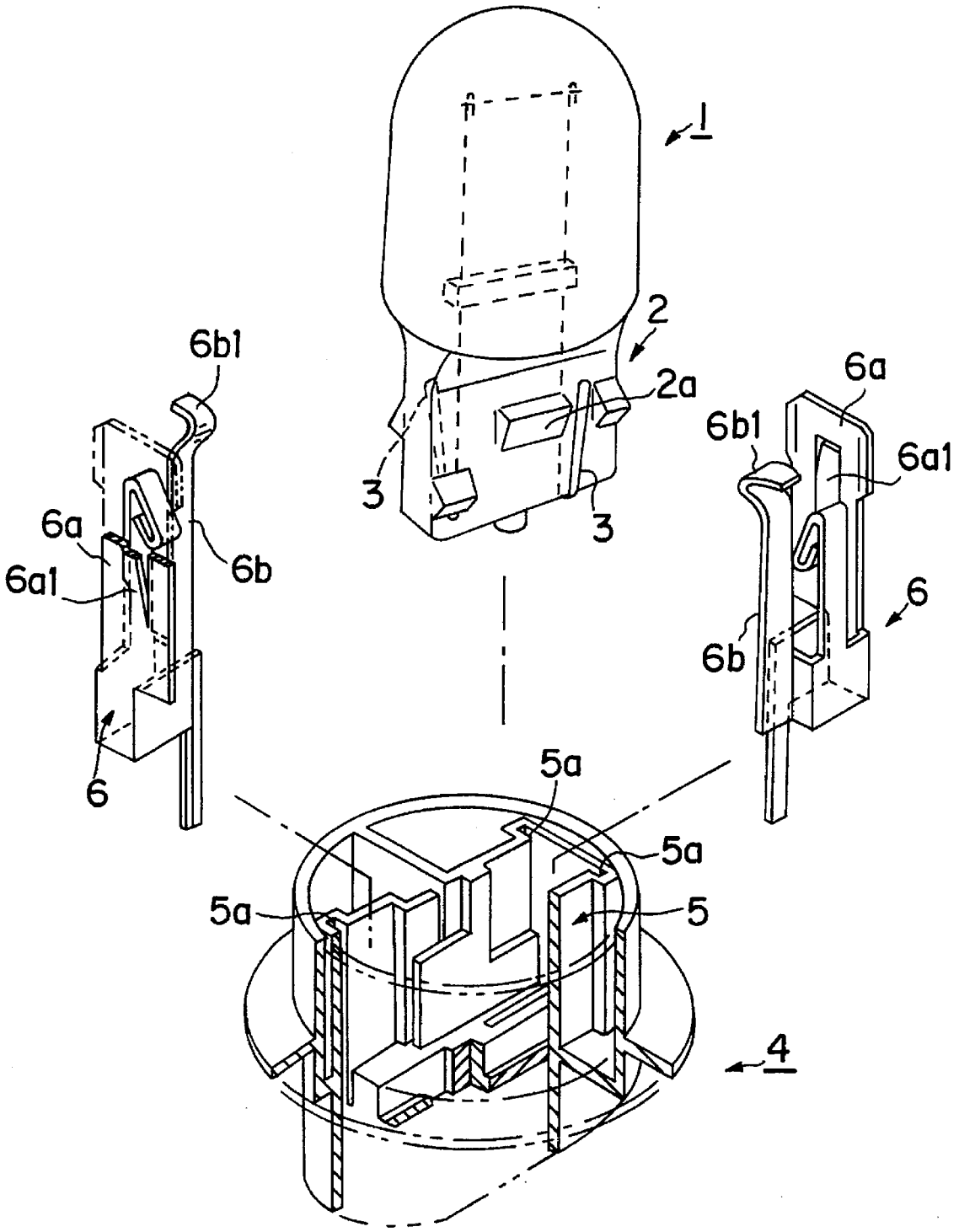
FIG. 16 PRIOR ART
FIG. 16 is an exploded perspective view of a prior art bulb socket.

Further modifications of the second aspect of the Invention, as shown in FIGS. 14 and 15, are designed to prevent deformation of the contact fittings due to the use of a wrench. In the form of the Invention shown in FIG. 14, similarly to that of FIG. 11, the upper end face of the wall of the receptacle is below that of the outer wall, thereby reducing the exposure of the contact member. FIG. 15, a U-shaped force absorbing portion is formed between the leading end of movable contact member 34 and pressing portion 34*a*. When urged outward, this U-shaped portion comes into contact with the inner surface of the outer wall, thereby absorbing at least some of the force pressing outward.

It will be appreciated that, since the foregoing embodiment is merely an example of the Invention, it is broad enough to include modifications which will suggest themselves to the person of ordinary skill. Although arm 23 is formed by slits 22 extending from the open edge of side wall 36 of receptacle 21 in the foregoing embodiment, a substantially U-shaped notch may be formed in side wall 36 to make side wall 36 more flexible. Movable contact 34 may be supported by this side wall. Further, a projecting arm portion may be formed on the inner wall of receptacle 21 to support contact 34. Although electrode 33 and contact 34 are integrally formed as part of contact fitting 30, they may alternatively be separately formed. Moreover, the bulbs are not limited to wedge-base bulbs 10, but may be electric bulbs of other types which can be tightly retained by contact fittings 30 in receptacle 21. It is also to be appreciated that the socket may be used with devices other than bulbs, such as fuses, diodes, transistors, resistors, electronic chips, switches, and the like. These and other modifications may be made to the present Invention without departing from the scope and spirit thereof. It is to be broadly construed and not to be limited except by the character of the claims appended hereto.

What we claim is:

1. An electrical socket for receiving an element which is an electric light bulb having a wedge-shaped base, said electrical socket comprising a receptacle receiving at least one contact fitting, said receptacle including at least one elongated arm integrally connected to said socket and contact with said arm being deflectable upon insertion of said base into said socket and said arm having a locking part receiving a locking device secured to said contact fitting, said locking part being a tubular end.

2. The socket of claim 1 wherein said tubular end is adjacent a leading end of said arm.

3. The socket of claim 1 wherein said locking part is a hole into which said locking device enters.

4. The socket of claim 3 wherein said hole is a through hole.

5. The socket of claim 3 wherein said locking device comprises a U-shaped member which bears against said locking part.

6. The socket of claim 1 wherein an outer wall of said tubular end extends beyond a side wall of said receptacle.

* * * * *